US006877634B2

(12) United States Patent
Tramontina et al.

(10) Patent No.: US 6,877,634 B2
(45) Date of Patent: Apr. 12, 2005

(54) HIGH CAPACITY DISPENSING CARTON

(75) Inventors: Paul Francis Tramontina, Alpharetta, GA (US); Richard Paul Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/335,402

(22) Filed: Dec. 31, 2002

(65) Prior Publication Data

US 2004/0124207 A1 Jul. 1, 2004

(51) Int. Cl.[7] ..... A47K 10/24
(52) U.S. Cl. ..... 221/53; 221/311
(58) Field of Search ..... 221/33, 53, 55, 221/45, 48, 63, 303, 311, 312 R; 312/42; 206/45.26, 45

(56) References Cited

U.S. PATENT DOCUMENTS

| | | | | |
|---|---|---|---|---|
| 2,501,357 A | | 3/1950 | Speckman et al. | |
| 2,919,020 A | | 12/1959 | McCleary | |
| 3,001,645 A | | 9/1961 | Hernberg | |
| 3,014,634 A | | 12/1961 | Humphrey et al. | |
| 3,066,843 A | | 12/1962 | Johnson | |
| 3,156,378 A | * | 11/1964 | Bua | 221/197 |
| 3,210,140 A | * | 10/1965 | Smythe | 312/42 |
| 3,301,746 A | | 1/1967 | Sanford et al. | |
| 3,322,617 A | | 5/1967 | Osborne | |
| 3,450,308 A | | 6/1969 | Schoenefeld | |
| 3,522,878 A | | 8/1970 | Rosenburg, Jr. | |
| 3,650,882 A | | 3/1972 | Thomas | |
| 3,750,930 A | | 8/1973 | Roth | |
| 3,765,565 A | | 10/1973 | Fietzer et al. | |
| 4,020,946 A | | 5/1977 | Gardner et al. | |
| 4,100,324 A | | 7/1978 | Anderson et al. | |
| 4,252,236 A | | 2/1981 | Roccaforte | |

(Continued)

FOREIGN PATENT DOCUMENTS

| | | |
|---|---|---|
| DE | 927380 | 5/1955 |
| EP | 1297771 | 4/2003 |
| FR | 2115834 | 7/1972 |
| SE | 149028 | 3/1955 |
| WO | 99/30601 | 6/1999 |

OTHER PUBLICATIONS

Internet Product Page, Dec. 26, 2002, The Grabber® Dispenser.
Internet Product Page, Dec. 26, 2002, ACCESS® Wiper Dispenser.
Internet Product Page, Dec. 26, 2002, Wypall® L30 Economizer® Wipers.
Internet Product Page, Dec. 26, 2002, WYPALL® L40 Wipers.
Internet Product Page, Dec. 26, 2002, Wypall® Teri® X60 Reinforced Wipers.

*Primary Examiner*—Kenneth Noland
(74) *Attorney, Agent, or Firm*—Sue C. Watson; Douglas H. Tulley, Jr.

(57) ABSTRACT

A disposable dispensing carton for paper and nonwoven sheet materials is provided that can be made from paperboard blanks and includes a set or ridges, integral with the dispensing carton, that extend into the interior area of the dispensing carton adjacent the dispensing opening located in the bottom of the carton. The ridges off-set the weight of the overlying sheets to a degree that allows the dispensing carton to employ heights in excess of about 40 cm as well as hold and dispense stacked paper products having sheet counts between about 250 and about 1000 sheets.

24 Claims, 17 Drawing Sheets

U.S. PATENT DOCUMENTS 4,382,526 A 5/1983 Stone
4,410,221 A 10/1983 Vallis et al.
4,411,374 A 10/1983 Hotchkiss
4,416,369 A 11/1983 Burns
4,436,780 A 3/1984 Hotchkiss et al.
4,469,243 A 9/1984 Ito et al.
4,623,074 A 11/1986 Dearwester
4,646,937 A 3/1987 Doshi
4,648,536 A 3/1987 VanderLugt
4,659,609 A 4/1987 Lamers et al.
4,737,393 A 4/1988 Linkous
4,813,539 A 3/1989 Church et al.
4,989,735 A 2/1991 O'Brien
5,048,589 A 9/1991 Cook et al.
5,137,211 A 8/1992 Summer et al.
5,219,092 A * 6/1993 Morand ..... 221/53
5,228,590 A 7/1993 Blasko et al.
5,265,758 A 11/1993 Saint Criq et al.
5,284,703 A 2/1994 Everhart et al.
5,399,412 A 3/1995 Sudall et al.
5,494,554 A 2/1996 Edwards et al.
5,607,551 A 3/1997 Farrington, Jr. et al.
5,672,248 A 9/1997 Wendt et al.
5,716,691 A 2/1998 Chan
5,772,845 A 6/1998 Farrington, Jr. et al.
5,776,306 A 7/1998 Hepford
6,077,590 A 6/2000 Archer et al.
6,096,152 A 8/2000 Anderson et al.
6,186,393 B1 2/2001 Tsamourgelis
6,273,996 B1 8/2001 Hollenberg et al.
6,415,949 B1 7/2002 Tramontina
6,422,416 B1 7/2002 Tramontina

* cited by examiner

HIGH CAPACITY DISPENSING CARTON

BACKGROUND

Numerous disposable dispensing cartons and containers have previously been utilized to dispense paper products such as napkins, facial tissue, towels, wipes and so forth. These dispensing cartons have been provided with various dispensing ports and configurations to enhance the display and/or dispensing of the paper products contained therein. However, many disposable dispensing cartons are capable of providing reliable dispensing only when there is little or no pressure or weight bearing upon the sheet to be dispensed. Accordingly, disposable dispensing cartons that dispense the pressure-bearing sheet can suffer from poor or inadequate dispensing. In this regard, it is noted that dispensing through a lower portion of the dispenser requires removal of a sheet that is bearing the weight of the over-lying paper products. As examples, problems associated with dispensing pressure-bearing sheets include the formation of unwanted tears or tabs in the sheets and loss of sheet leads (i.e. the exposed portion of the next sheet to be dispensed that extends outwardly from the dispensing aperture). Dispensing difficulties of this nature can be further increased by high capacity dispensing cartons that have increased numbers of paper products. Thus, there exists a need for disposable dispensing cartons configured to reliably dispense pressure-bearing sheets, such as through a lower portion of the dispenser, and that are capable of providing reliable dispensing even when using significant numbers of paper products.

SUMMARY OF THE INVENTION

In one aspect, the present invention generally provides a disposable dispensing carton comprising a plurality of sidewalls and first and second end walls defining an interior area, a dispensing aperture at least partially located within or proximate the first end wall, and a plurality of ridges proximate the dispensing opening. The ridges can extend substantially perpendicular to the dispensing opening and slope downwardly toward the dispensing opening. The ridges are integral with at least one of the walls, thereby forming a permanent part of the dispensing carton. Desirably, the sidewalls have a height of at least about 35 cm and/or are sized to hold a stack of at least 250 sheets. The dispensing aperture can be located entirely within the first end wall, entirely within one or more sidewalls, or at least partially within both the first end wall and sidewalls. In one embodiment, the disposable dispensing carton can include a first set of ridges adjacent a first side of the dispensing aperture and a second set of ridges adjacent a second, opposing side of the dispensing aperture. In a further embodiment, the ridges can be formed from and extend from one or more walls of the dispensing carton. Still further, the ridges can have a width, along their apex, less than about 0.5 cm and a height of between about 2.5 cm and about 6 cm.

In some embodiments, the disposable dispensing carton can also include one or more protruding members, extending into the interior area, integral with at least one of the sidewalls. The protruding member(s) desirably slope downwardly towards the dispensing aperture and can extend into said interior area between about 0.5 and about 3 cm. In one embodiment, the dispensing carton is formed from at least first and second blanks wherein the first blank forms the dispensing aperture and one or more openings proximate the dispensing aperture and the second blank forms a member having a plurality of ridges sized and spaced for insertion into the openings. In a further embodiment, the openings can be in the first end wall and/or one or more sidewalls wherein the ridges extend from a ridge member attached to the wall having said openings. In still a further embodiment, the ridges can be formed from and extend from the first end wall and/or one or more sidewalls and wherein openings are located in the wall adjacent the ridges. Additionally, the disposable dispensing carton can contain two or more dispensing apertures such as dispensing apertures located within and/or proximate both the first and second end walls. Further, the disposable dispensing carton can include one or more sets of ridges adjacent each of the dispensing apertures. The disposable dispensing carton can dispense various products such as a stack of superposed sheets selected from the group consisting of nonwoven and paper products.

In a further aspect, the present invention also generally provides a disposable dispensing carton comprising a plurality of sidewalls and first and second end walls defining an interior area; a dispensing aperture located in the first end wall; and a first support member forming a downwardly sloping plane adjacent a first side of the dispensing aperture and wherein the first support member being integral with at least one of the walls. The dispensing carton can further include a plurality of protruding members extending into the interior area wherein said protruding member is integral with at least one of the sidewalls. The protruding members are desirably formed from and extend from the sidewalls and further wherein the protruding members slope downwardly towards the dispensing aperture. The protruding members can extend into said interior area between about 0.5 and about 3 cm. The dispensing carton can include and dispense a stack of superposed sheets positioned at least partially over the dispensing aperture. In one embodiment, the dispensing aperture can be located entirely within the first end wall. Still further, the disposable dispensing carton can also include a second support member forming a downwardly sloping plane adjacent a second, opposite side of the dispensing aperture. In one embodiment, the first and/or second support members can have a substantially triangular shape. The disposable dispensing carton can also include a dispensing aperture flap attached to the first side of the dispensing aperture and wherein the dispensing aperture flap is in facing relationship with the sloping surface of the first support member. The carton can also include a third support member forming a downwardly sloping plane adjacent the first side of the dispensing aperture and wherein the first and third support members extend inwardly from adjacent one of said sidewalls to at least adjacent the edge of the dispensing aperture. In one aspect, the support members can have a height between about 2 cm and about 8 cm and further, can extend into the interior area between about 2 cm and about 5 cm.

DESCRIPTION OF THE INVENTION

Figure 1A:
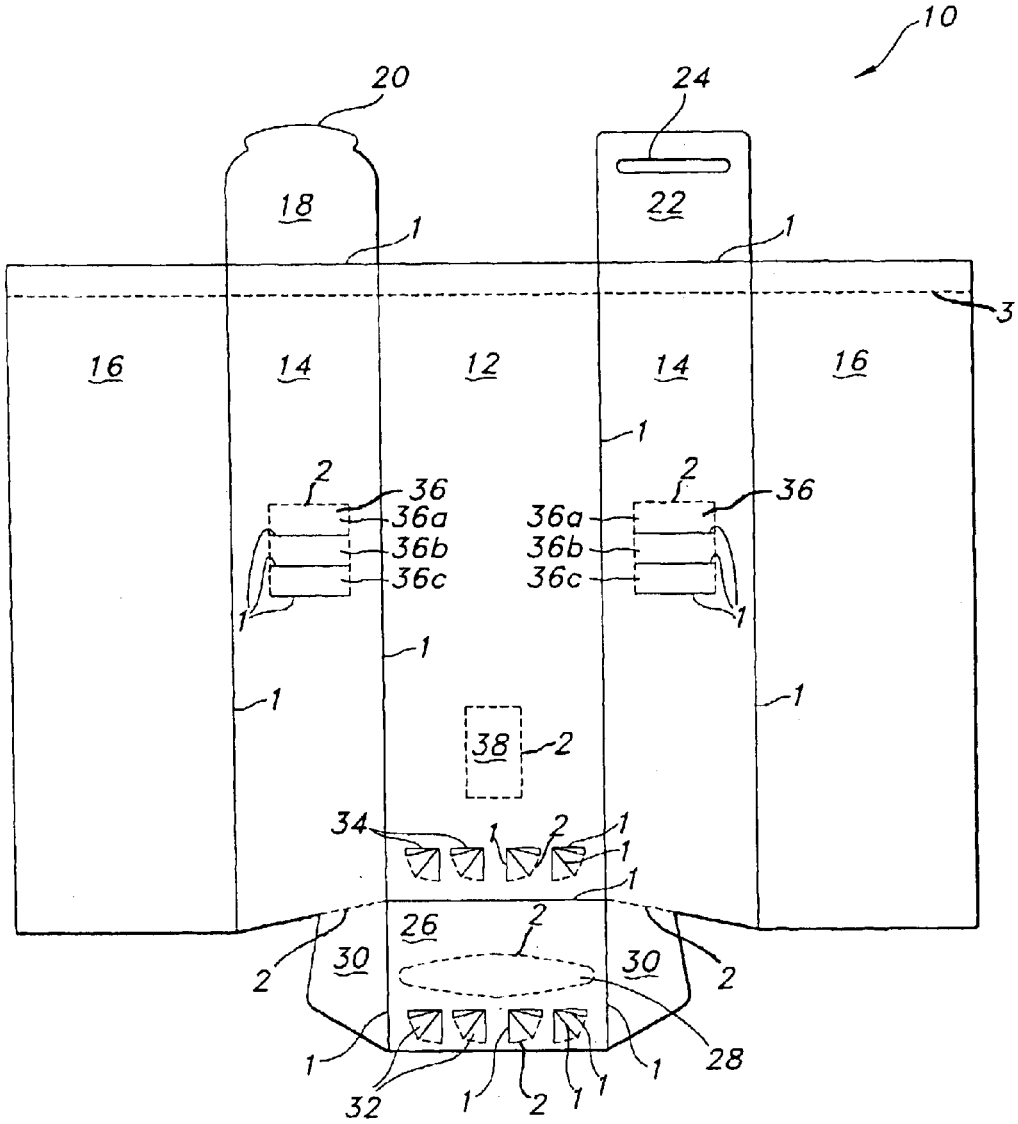
FIG. 1A is a flat-wise view of a blank for making a dispensing carton of the present invention.

Reference will now be made in more detail to various embodiments of the invention, one or more examples of which are illustrated in the drawings. Each example is provided by way of explanation of the invention and not meant as a limitation of the invention. For example, features illustrated or described as part of one embodiment or figure can be used on another embodiment or figure to yield yet another embodiment. It is intended that the present invention include such modifications and variations. In addition, in discussing the particular embodiments of the dispensing cartons shown and described herein, reference is made to "top", "bottom", "front", ""rear" and so forth. However, such terms have been used in reference to the cartons as depicted in the accompany drawings for perspicuity only and it is expressly noted that, during use, the dispensing carton could be rotated or otherwise positioned as desired.

In reference to FIG. 1A, blank 10 is provided for forming a disposable dispensing carton. One or more various inexpensive and lightweight materials known in the art can be used to form blank 10. By way of example only, the blank can comprise paperboard such as, for example, cardboard, corrugated cardboard, fiberboard, composite materials and so forth. In addition, the paperboard can be combined or treated with one or more additional materials in order to improve the strength, water resistance, colorfastness or other characteristics as desired. By way of example only, the paperboard can be coated or impregnated with one or more resins or polymeric materials such as waxes, polyolefins, polyvinylidine chlorides, polyvinyl chlorides and so forth. In addition, the dispensing carton can comprise, in whole or in part, laminate or multi-layer materials such as, for example, two or more layers of paperboard bonded together. Further, supporting elements or materials may be used in conjunction with the blank and corresponding carton as desired.

Figure 1B:
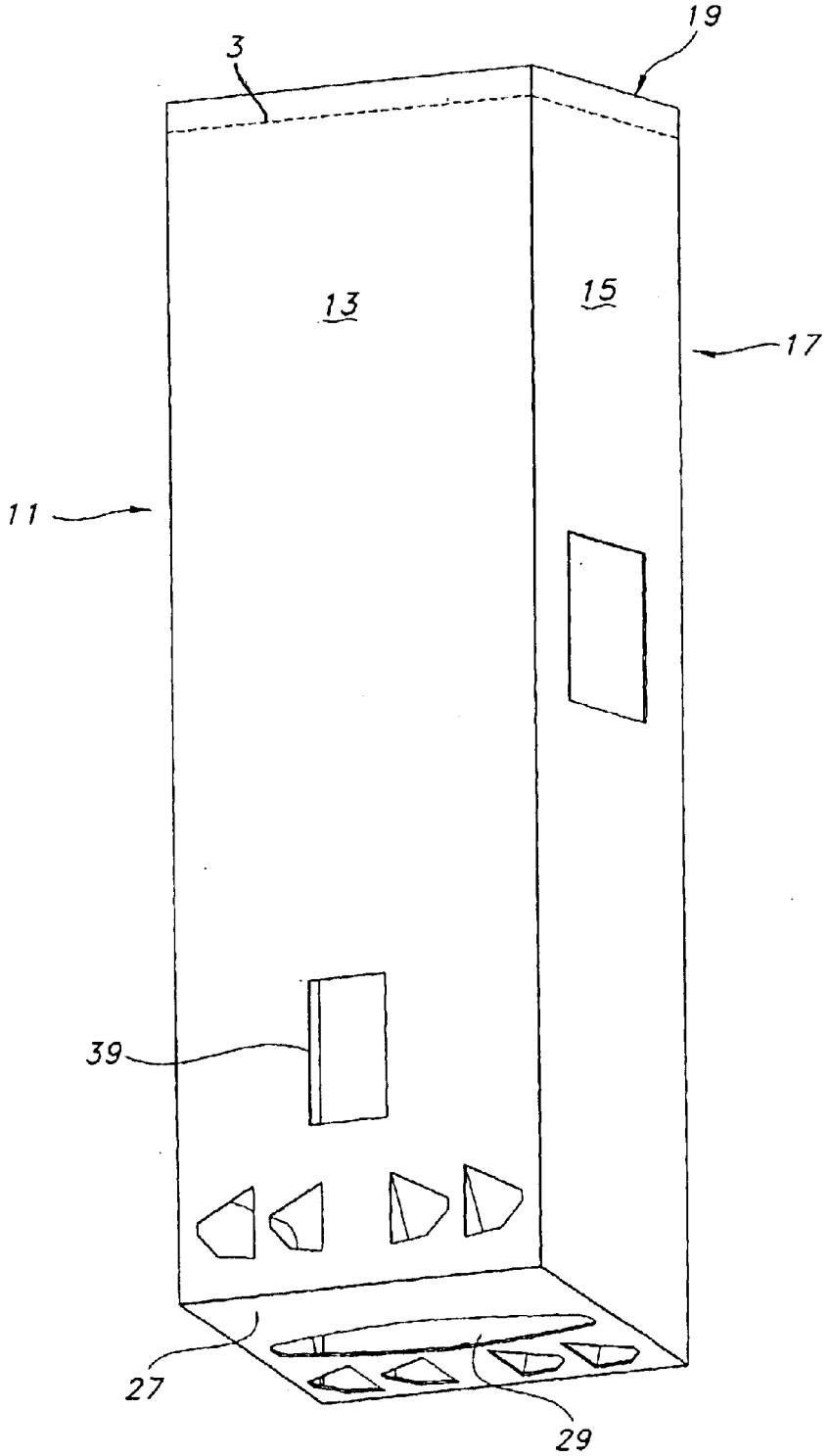
FIG. 1B is an angled, front view of a dispensing carton made from the blank of FIG. 1A.
Figure 1C:
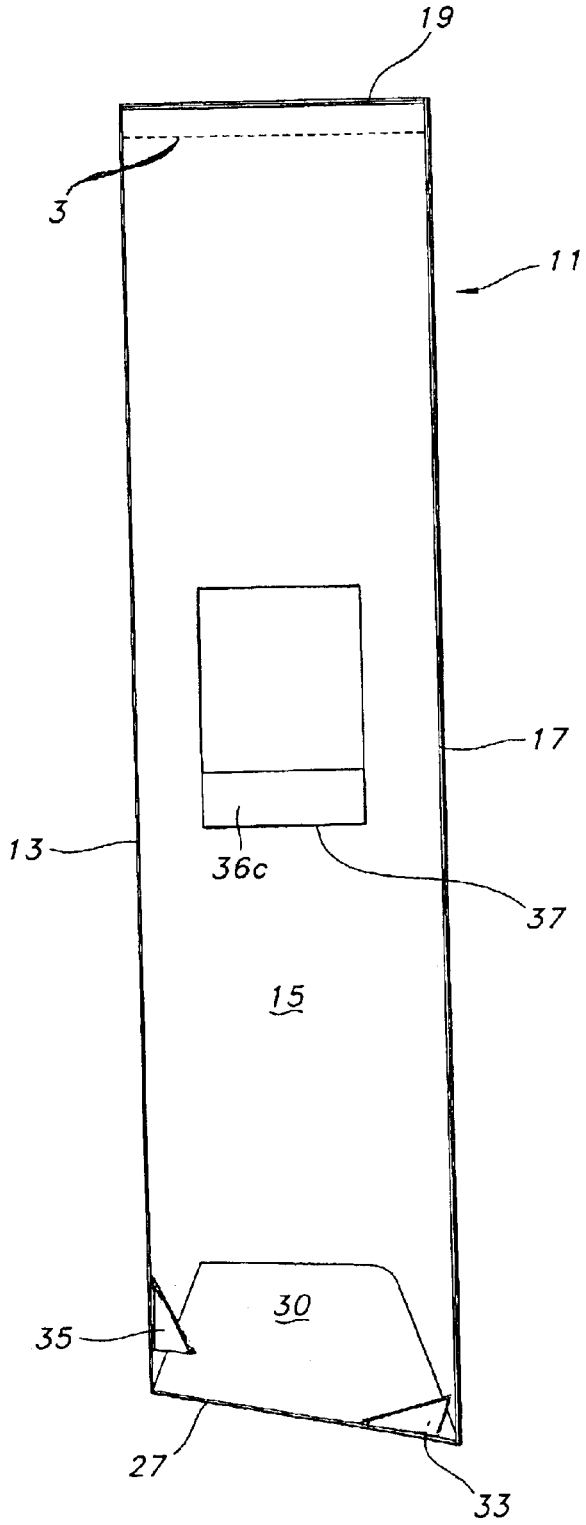
FIG. 1C is a side view of the dispensing carton of FIG. 1B taken from the medial plane.
Figure 1D:
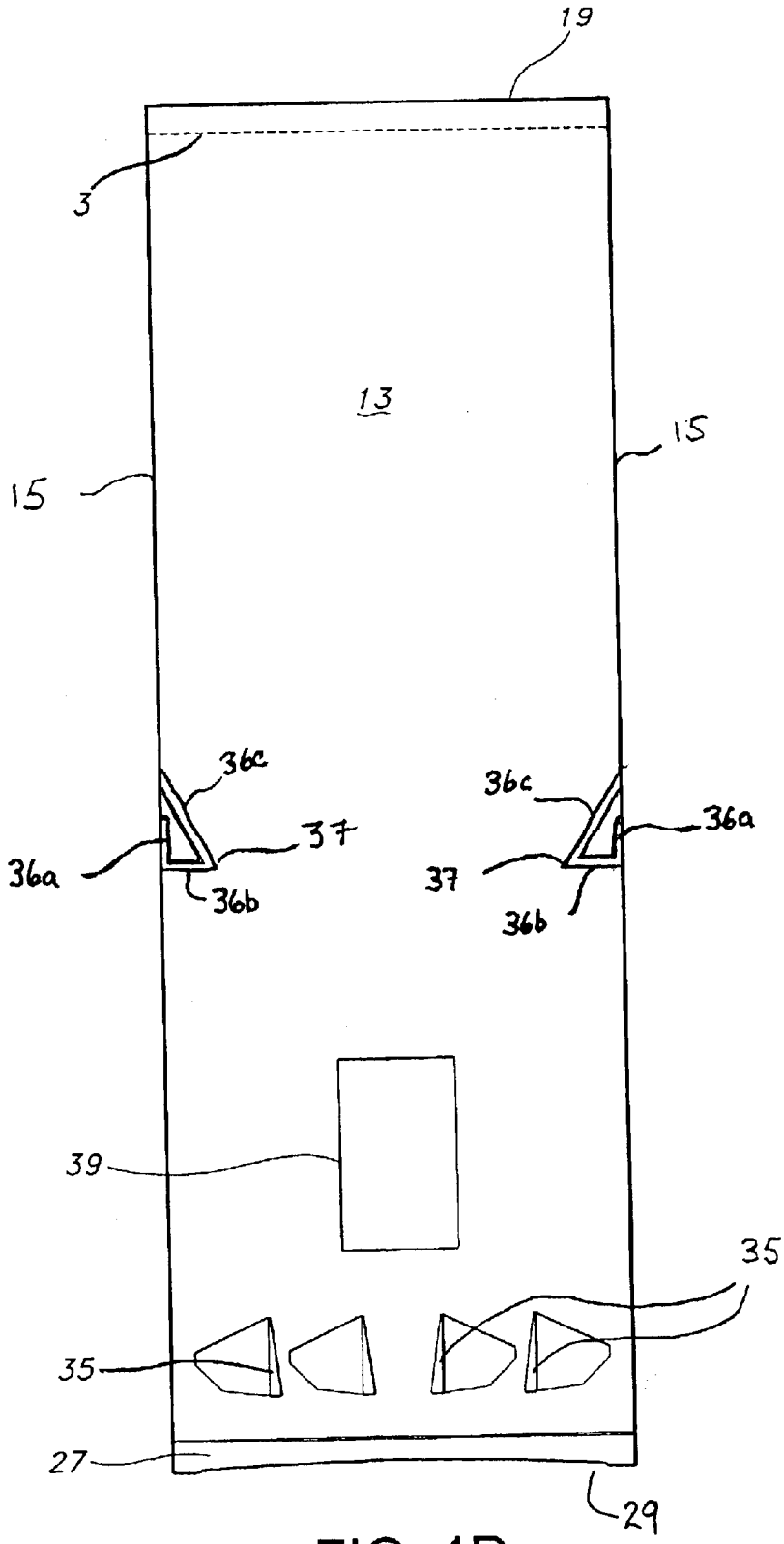
FIG. 1D is a rear view of the dispensing carton of FIG. 1*b* taken from the medial plane.
Figure 1E:
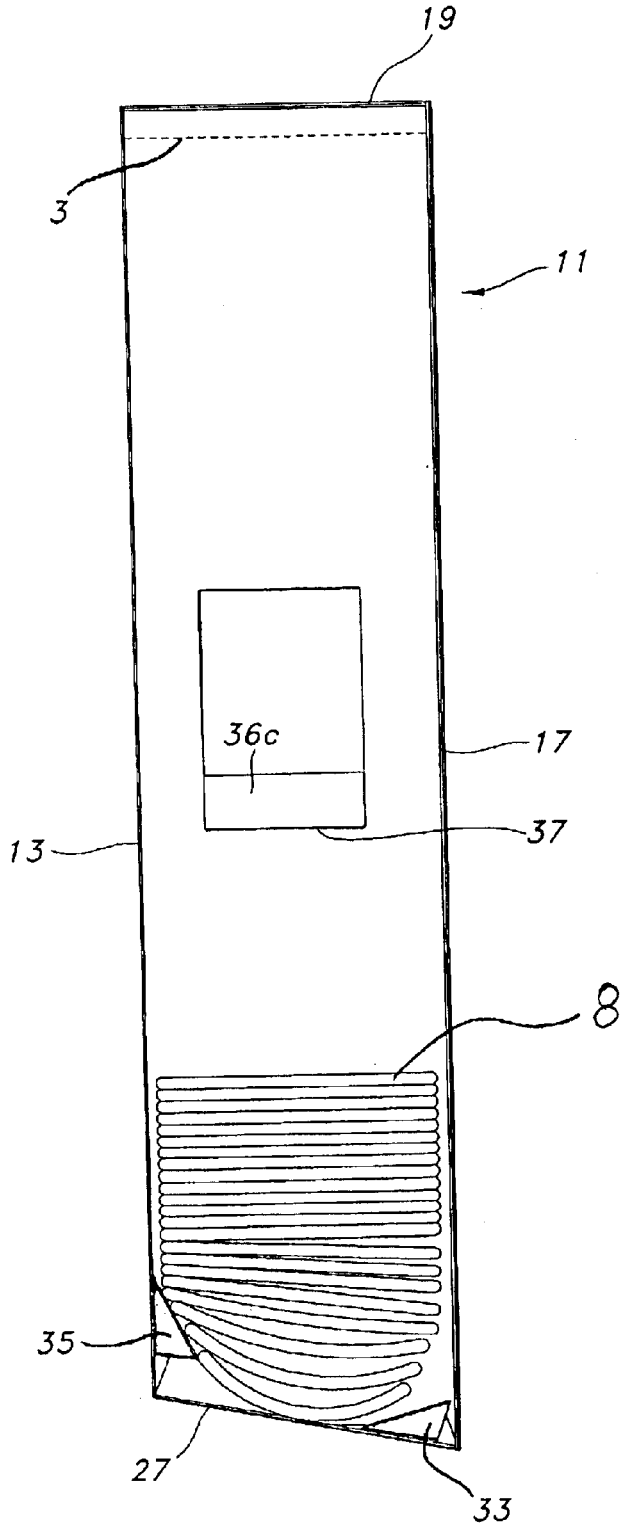
FIG. 1E is a side view of a dispensing carton of FIG. 1C containing paper product.

Fold lines 1 generally indicate the manner and location that blank 10 is to be folded in order to form the corresponding dispensing carton 11 depicted in FIGS. 1B–1D. In addition, depending upon the manner in which blank 10 will be folded, it may be desirable for fold lines 1 to be scored or treated in another manner known in the art to improve the ease and/or reliability of forming a fold in a pre-determined location. Blank 10 also has a plurality of slits or cut lines 2 therein. Cut lines 2 can be formed be formed when forming the blank itself or alternatively cut lines 2 can be formed subsequently thereto such as during assembly or just prior to use of the carton. When cut lines 2 are formed after formation of the blank 10, it may often be desirable to form lines of weakness such as by scoring, perforating and/or other mechanisms known in the art for improving the ease and/or reliability of slitting or separating materials in a pre-determined location.

Blank 10 has front wall section 12, sidewall sections 14 and back wall sections 16 which, in reference to FIG. 1A, are separated by fold lines 1. In one embodiment, wall sections 12, 14, 16 can have a continuous line of weakness 3 extending across all of the sections. The front wall section can include ridge flaps 34, the periphery of which is formed partly by fold line 1 and cut lines 2. In addition, front wall 12 can further include window panel 38 defined along its periphery by cut lines 2. Sidewall sections 14 can also include bumper flaps 36 defined in part by fold line 1 and in part by cut lines 2. Blank 10 can further include first top flap 1*a* having tab 20 and second top flap 22 having opening 24 therein. The blank can further include bottom flap 26 that includes dispensing aperture panel 28, side extensions 30 and ridge flaps 32. The entire periphery of dispensing aperture panel 28 is defined by cut line 2. However, the outer periphery of ridge flaps 32 are formed by fold lines 1 and also cut lines 2.

In reference to FIGS. 1A–1D, dispensing carton 11 is formed by folding wall sections 12, 14, 16 to approximately ninety-degree angles along fold lines 1 thereby forming a rectangular carton having four vertical sidewalls 13, 15, 17 which, for purposes of clarity, are herein after referred to as front wall 13, side walls 15 and back wall 17. The width of wall sections 12, 14, 16 can be selected to correspond to the dimensions of the stacked product to be dispensed. Further, in order to provide increased holding capacity, wall sections 12, 14, 16 desirably have a height of at least about 35 cm. In certain embodiments, wall sections 12, 14, 16 can have a height between about 38 cm and about 100 cm. In still further embodiments, wall sections 12, 14, 16 can have a height between about 40 cm and about 75 cm. The back wall sections 16 at least partially overlap one another and the overlapping wall sections 16 are affixed to one another to form back wall 17. Overlapping sections can be affixed to one another utilizing adhesives and/or fasteners. Exemplary adhesives include, but are not limited to hot melt adhesives such as those commercially available under the trade name JETMELT adhesives from 3M Company of Minneapolis, Minn. Fasteners that join, connect or otherwise hold the components together can also affix overlapping sections to one another. By way of example only, suitable fasteners include, but are not limited to, staples, stitching, tacks, pins, tapes, hook fasteners, loop fasteners, interlocking male/female connectors and so forth.

Front wall section 12 can further include a removable window panel 38. The periphery of the window panel 38 is formed by cut lines 2. Window panel 38 can be removed by detaching the same along cut lines 2 prior to forming dispensing carton 11 or from the front wall 13 after formation of dispensing carton 11. Once window panel 38 is removed, window 39 is formed that provides front wall 13 with an aperture or window for viewing the contents within dispensing carton 11. Window 39 allows the end users to more reliably track product usage and predict when the carton will be emptied. The size, number and placement of window sections and corresponding windows can vary as desired. In addition, line of weakness 3 adjacent top wall 19 allows removal of a top portion of the dispensing carton 11. Thus, the dispensing carton can be used in an inverted position and the paper products within the carton can be urged towards dispensing opening by a spring-loaded plate or other mechanism for urging paper products towards the dispensing opening.

First and second top flaps 18, 22 are also folded at fold lines 1 at approximately ninety-degree angles. Tab 20 of first top flap 18 is inserted into opening 24 of second top flap 22 thereby mechanically engaging second top flap 22. Engaged first and second top flaps 18, 20 together form top end wall 19. In an alternate embodiment (not shown), the top wall can be formed from a single flap that has a lip that folds downwardly and is capable of being attached to one or more adjacent walls 12, 14, 16.

Bottom flap 26 is folded upwardly and attached to an adjacent wall. In reference to FIGS. 1A–1D, side extensions 30 of bottom flap 26 are separated from sidewall 14 along cut lines 2 and folded upwardly along fold line 1 to approximately a ninety-degree angle. In addition, bottom flap 26 is folded towards back wall 17 along fold line 1 to an extent that allows side extensions 30 to overlap and/or engage sidewalls 15. By way of example, side extensions 30 can be affixed to sidewalls 15 using a hot melt adhesive. Desirably, bottom flap 26 is folded under to an extent that bottom end wall 27 is substantially parallel with the bottom edges of sidewalls 15. In the embodiment depicted in FIG. 1B, bottom end wall 27 and the bottom of sidewalls 15 are not parallel with the horizon and are sloped upwardly from back wall 17 to front wall 13. However, it is noted that the slope or angle, if any, of bottom end wall 27 can vary as desired. Further, while not shown, it will be understood that the bottom end wall can be folded along one or more lines wherein the bottom end wall slopes downwardly towards the dispensing aperture. By way of example, a single fold line across the center of the bottom flap, parallel to front and back walls, would form a generally wedge-like structure. Further, use of two fold lines parallel to the front and back walls, such as one fold line extending adjacent each edge of the dispensing aperture, would form a frustum or trapezoid-like structure. In such embodiments, the sidewalls could simply be cut to correspond to the shape and structure of the folded bottom end wall.

Bottom flap 26 also includes dispensing aperture panel 28 defined on its periphery by cut lines 2. Removal of the dispensing aperture panel 28 forms dispensing aperture 29. Dispensing apertures of numerous sizes and shapes are known in the art and believed suitable for use in the present invention. The ultimate configuration of the dispensing aperture 29 will often depend upon the characteristics of the paper product to be dispensed (e.g. basis weight, stiffness, etc.), the form of the product stack (e.g. whether the products are inter-folded, tabbed, etc.) and the desired number of paper products to be dispensed at a time. With regard to dispensing characteristics, the dispensing aperture can be configured, in terms of size and shape, to provide limited sheet dispensing, that is to say allowing dispensing of not more than about 10 sheets at a time. In certain embodiments, the dispensing aperture can be configured to allow dispensing of between 1 and 8 sheets at a time or between 2 and 8 sheets at a time. In still other embodiments, the dispensing aperture can be configured to provide dispensing of only 1 sheet at a time. Further, the dispensing aperture can be formed entirely within bottom end wall 27, entirely within a lower portion of front wall 13 proximate bottom end wall 27, partly within both bottom end wall 27 and front wall 13, and so forth. By way of example only, various dispensing opening configurations are shown and/or described in U.S. Pat. Nos. 4,411,374; 4,469,243; 4,623,074; 6,378,746; 6,415,949; the entire contents of which are incorporated herein by reference. In addition, it will generally be understood that the panels or sections that are capable of being entirely removed from the dispensing carton, such as the dispensing aperture panel 28, can be removed from blank 10 prior to making the dispensing carton 11 or from formed dispensing carton 11 by the end user.

Figure 3A:
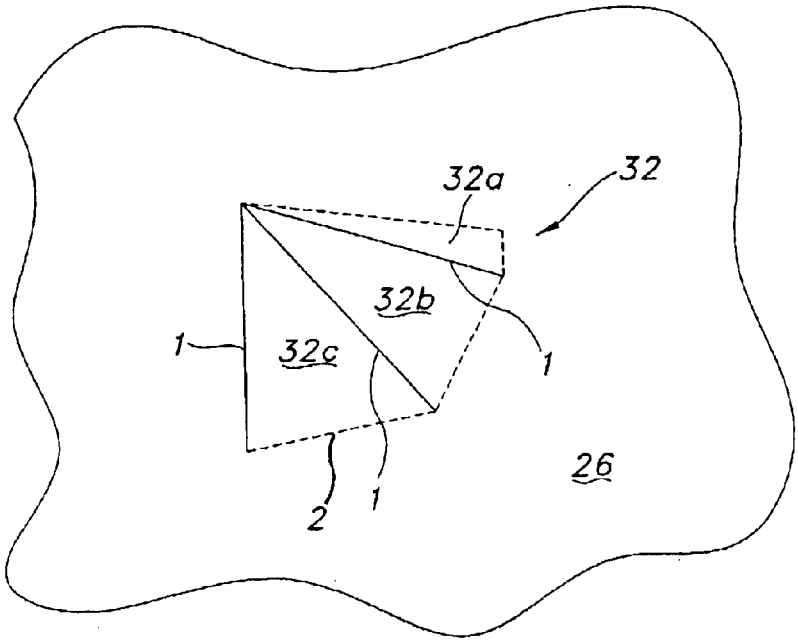
FIG. 3A is a blown-up view of a flap for forming a ridge.
Figure 3B:
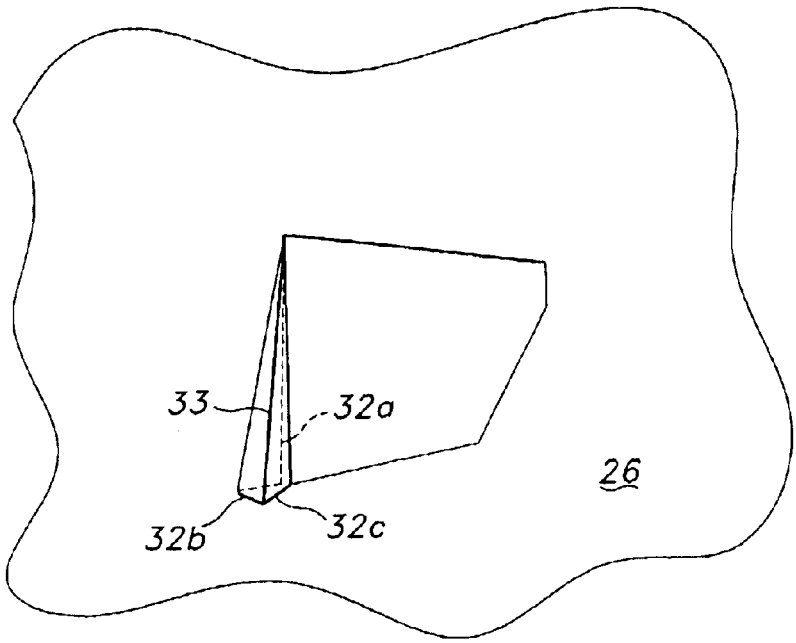
FIG. 3B is a ridge formed by the flap depicted in FIG. 3A.
Figure 4A:
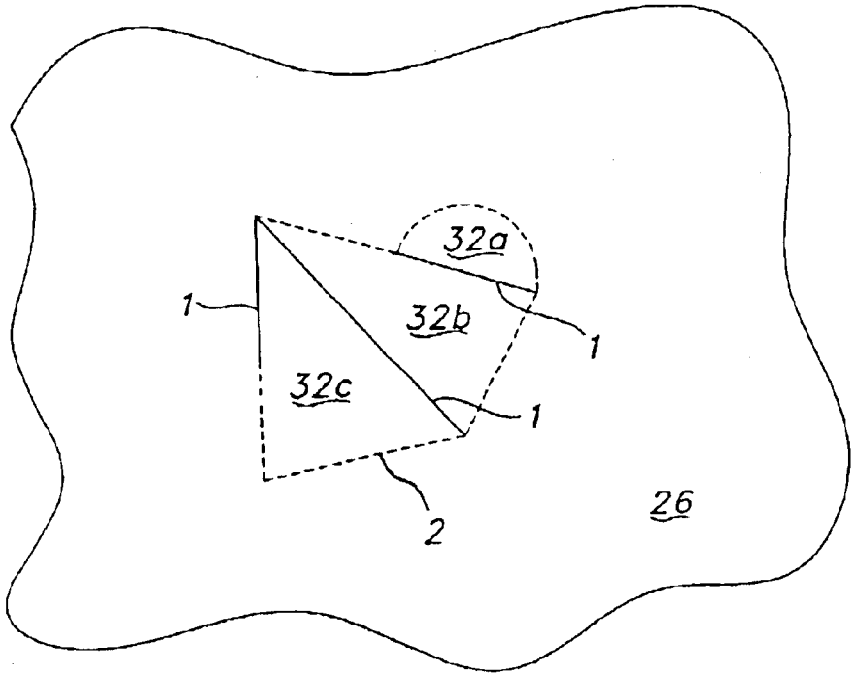
FIG. 4A is a blown-up view of a flap for forming a ridge.
Figure 4B:
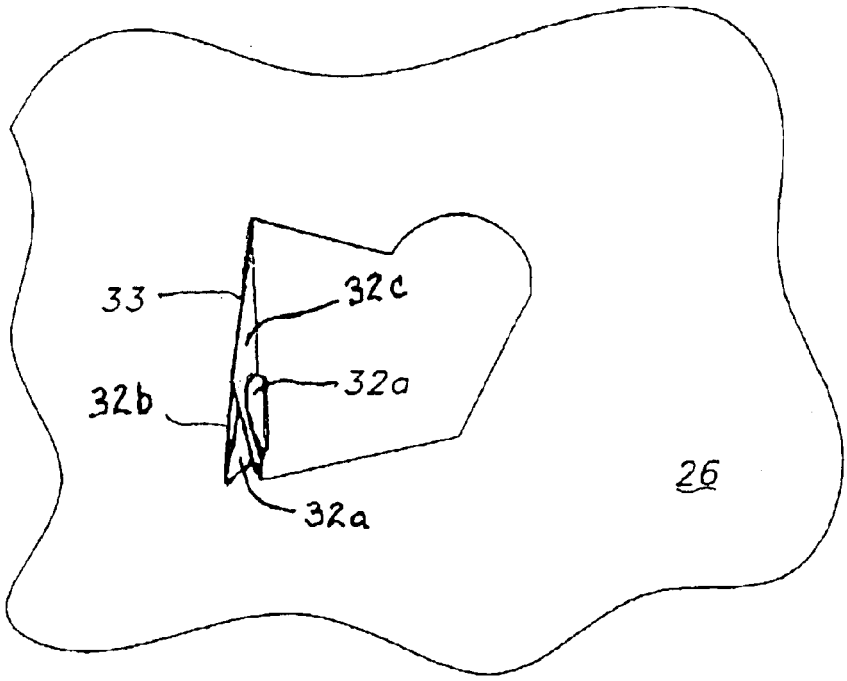
FIG. 4B is a ridge formed by the flap depicted in FIG. 4A.

Ridge flaps 32 are partially separated from bottom flap 26 along cut lines 2 and then folded inwardly along fold lines 1 to form rear ridge members 33. More specifically, and in reference to FIGS. 3A and 3B, the periphery of ridge flaps 32 are defined within bottom flap 26 by fold line 1 and cut lines 2. The view depicted in FIGS. 3A and 3B is from the reverse angle from FIG. 1. Ridge flap 32 is separated from bottom flap 26 along cut lines 2. Ridge flap sections 32*a*, 32*b* and 32*c* are then folded inwardly along fold lines 1 wherein ridge flap section 32*a* overlaps and lies flush with bottom flap 26 thereby forming ridge member 33 having a generally pyramidal-like structure. Overlapping sections can then be attached or otherwise fastened together by one or means as desired. In reference to the embodiment depicted in FIGS. 3A and 3B, ridge flap section 32*a* (shown in phantom in FIG. 3B) can be adhesively attached to bottom flap 26 thereby forming rear ridge members 33. Ridge flaps 34 on front wall 12 can be folded in a similar manner to form front ridge members 35. In an alternate embodiment, and in reference to FIGS. 4A and 4B, section 32*a* of ridge flap 32 is fed under sections 32*b* and 32*c* and folded upwardly to overlap section 32*c*. Section 32*a* can then be attached to section 32*c* to form ridge member 33 having a generally sliver-like structure. Section 32*a* can then be attached to section 32*c* thereby forming rear ridge members 33.

The size and shape of ridge members 33, 35 can vary in numerous respects. The size and shape of ridge members 33, 35 can be selected to cause the individual sheets of sheet stack 8 to bow outwardly in the direction of dispensing aperture 29 In certain embodiments, ridge members 33, 35 can have a maximum height between about 2 cm and about 8 cm. In still other embodiments, ridge members 33, 35 can have a maximum height between about 2.5 cm and about 6 cm. The height of the front ridge members 35 and rear ridge members 33 can be the same or different from one another. In one embodiment, when bottom end wall 27 is angled such as depicted in FIG. 1C, rear ridge members 33 desirably have a greater height than front ridge members 35. Ridge members 33, 35 can extend into the interior area of the dispensing carton 11 from at or about one or the walls to about the edge of the dispensing aperture. In certain embodiments, ridge members 33, 35 can extend into the interior area of the dispensing carton 11 about 2 to about 5 cm. In addition, the top portion or apex of ridge members 33, 35 desirably have a width or thickness less than 1 cm and, still more desirably, have a width less than about 0.5 cm. The spacing and number of the ridge members 33, 35 can vary. In certain embodiments, dispensing carton 11 can contain between about 3 and about 8 ridges proximate one or each side of dispensing aperture 29. Further, in one embodiment, ridge members 33, 35 can be spaced equidistant from one another.

Side protrusions or bumpers 37 can also be formed in the dispensing carton 11 from bumper flaps 36 located in sidewalls 14. Bumper flaps 36 are separated from sidewall 14 along cut lines 2. Individual sections 36*a*, 36*b* and 36*c* are folded inwardly along fold lines 1 wherein section 36*a* overlaps and lies substantially flush with sidewall 14. Individual sections 36*a*, 36*b*, 36*c* form a triangular-like structure wherein the plane formed by section 36*c* is sloped, extending from fold line 1 between sidewall 15 and first section 36*a*, downwardly towards dispensing opening 29. Section 36*a* of bumper flap 36 can then be attached to sidewall 14 as desired. In this particular embodiment, the degree to which bumper 37 extends into the interior of dispensing carton 11, and hence the degree to which bumper 37 extends into the flow path of the paper product, will correspond to the width of section 36*b* (i.e. the distance separating sections 32*a* and 32*c*). In certain embodiments, the bumper extends into the interior of dispensing carton 11 between about 0.5 cm and about 3 cm. In other embodiments, the bumpers extend between about 0.7 cm and about 1.5 cm into the interior of the dispensing carton 11. In addition, bumper 37 desirably has a length (i.e. the distance across sidewall section 14/sidewall15) of at least about 2.5 cm. In certain embodiments, bumper 37 can have a length between about 3 cm and about 6 cm. The dispensing carton 11 can contain one or more bumpers on any of the vertical walls 13, 15, 17. As specific examples, sidewalls 15 can each contain 1, 2 or three bumpers. Further, bumpers 37 can be positioned on opposing walls in a staggered relationship or, in the alternative, positioned directly opposite one another.

The order of folding and attaching the various individual sections of the blank to form the dispensing carton can vary as desired. In this regard, the blank can be folded and formed about the sheet stack. Alternately, the interior area of the dispensing carton can be substantially formed, the sheet stack inserted therein and then the dispensing carton fully formed and sealed. As an example, dispensing carton 11 can be fully formed with the exception that top wall 19, i.e. top flaps 18 and 22, remain unattached. A sheet stack 8 can then be inserted therein followed by engaging top flaps 18, 22 to form top end wall 19 and fully enclose the interior area of dispensing carton 11. However, generally speaking, it will often be advantageous to form the ridge members and bumpers prior to folding the vertical sidewalls and end walls to form the enclosed interior area.

In an alternate embodiment and in reference to FIGS. 2A–2D, side protrusions or bumpers 37 can be formed from bumper flap 36 which is defined by fold line 1 and cut lines 2 located in sidewall 14. Bumper flap 36 includes first section 36*a* and second section 36*b* separated by a single fold line 1. Bumper flap 36 is separated from sidewall 14 along lines of weakness 2 and folded inwardly along the portion of bumper flap 36 remaining attached to sidewall 14, e.g. along fold line 1. Bumper flap 36 is also folded along fold line 1 located between sections 36*a* and 36*b*. Thus, bumper flap 36 forms bumper 37 having a generally "V" shaped structure wherein section 36*a* rests against the inside surface of sidewall 14. The resulting protrusion or bumper 37 is sloped downwardly towards the bottom end wall 27 and extends into the interior of the dispensing carton as a result of the resistance of the material to fully fold one hundred and eighty degrees. The degree to which bumper 37 extends into the interior of the dispenser can be controlled by varying the size of the individual sections 36*a* and 36*b*, the thickness of the material comprising the flap, the degree of scoring within the associated fold lines 1 and so forth.

Still in reference to FIGS. 2A–2D, the body of dispensing carton 11 can be formed by folding wall sections 12, 14 and 16 at approximately ninety-degree angles to one another. Back wall section 16 of blank 10 includes lip 40 extending there from. When wall sections 12, 14, 16 are folded at about ninety degree angles, lip 40 is likewise folded approximately ninety degrees and placed in overlapping relation to sidewall section 14. Lip 40 can, thus, be attached to sidewall 14 adhesively and/or by one or more fasteners. Further, lip 40 can be attached to either the interior or the exterior surface of sidewall section 14.

Figure 2A:
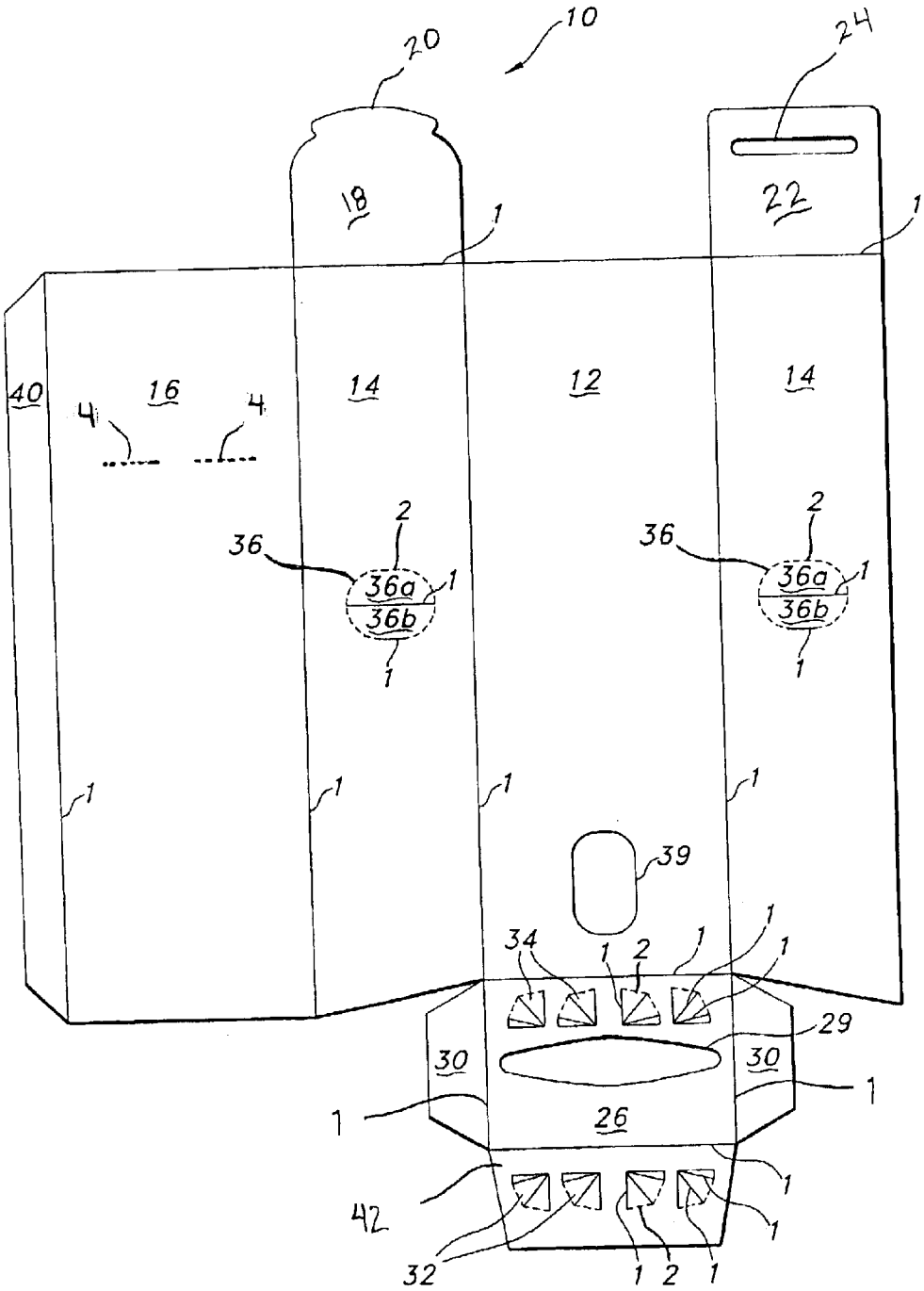
FIG. 2A is a flat-wise view of a blank for making a dispensing carton of the present invention.

In reference to FIG. 2A, blank 10 is provided with dispensing opening 29 and window 39. Thus, blank 10 of FIG. 2A is provided without removable panels 28 and 38 as provided in blank 10 of FIG. 1A. Accordingly, with regard to sections that can be entirely removed from the blank 10 or dispensing carton 11, it is noted that the blank 10 can be formed without the removable sections in the first instance thereby eliminating the need to detach and remove the same.

Figure 2B:
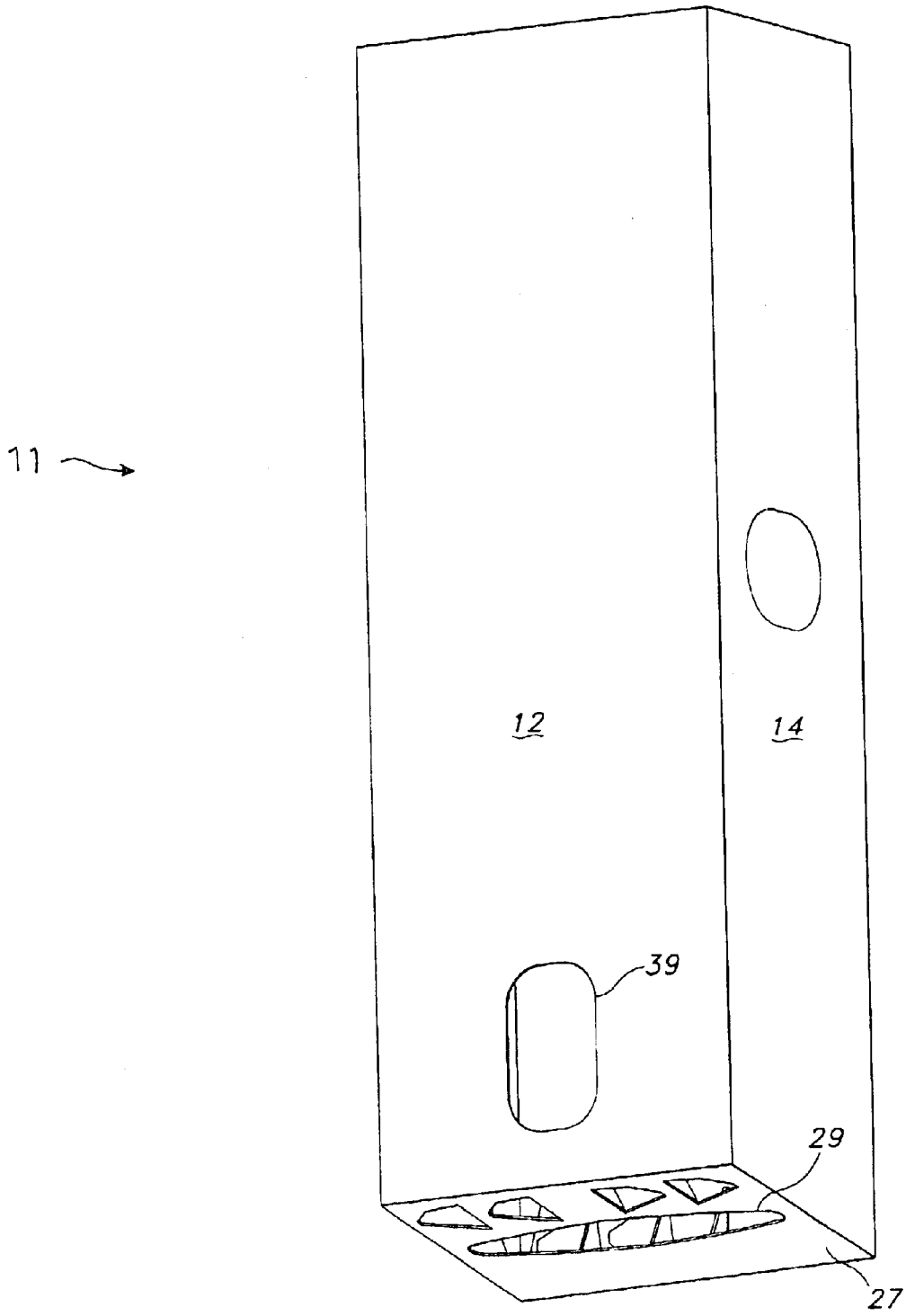
FIG. 2B is an angled, front view of a dispensing carton made from the blank of FIG. 2A.
Figure 2C:
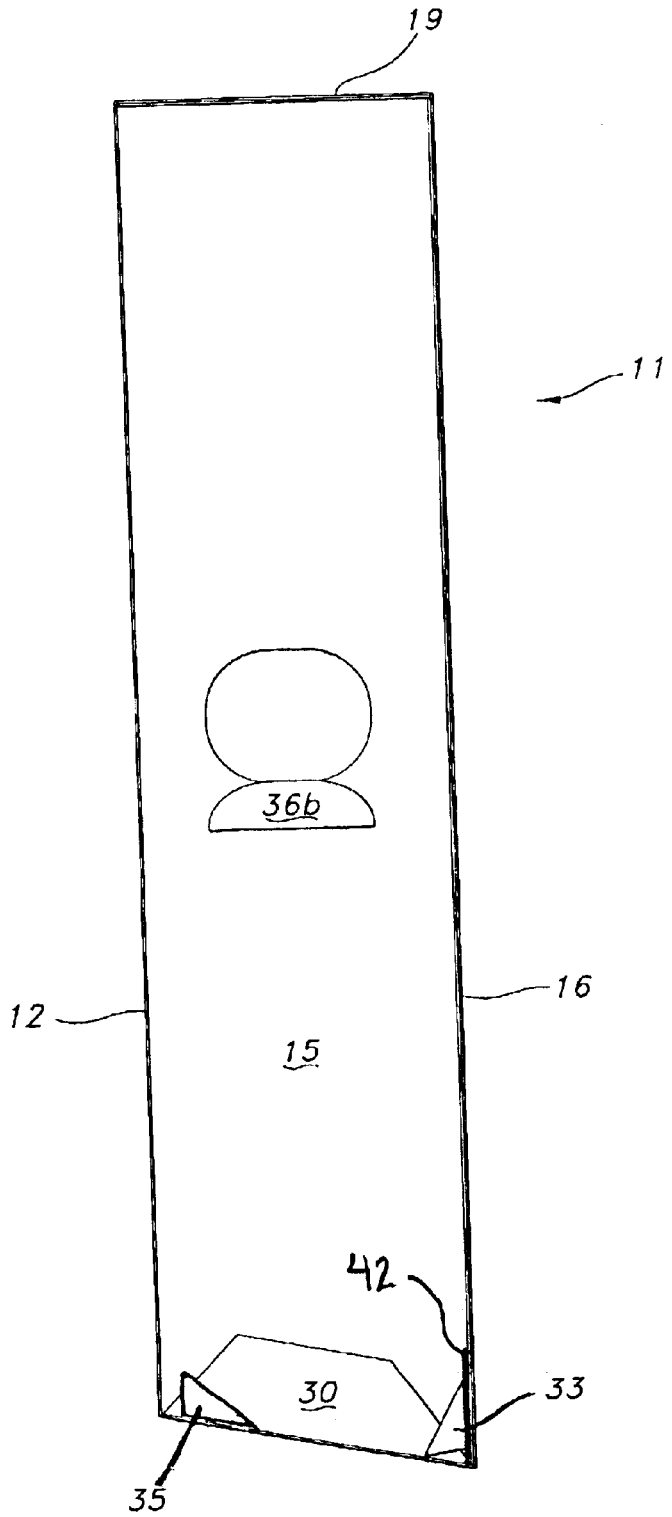
FIG. 2C is a side view of a dispensing carton, made from the blank of FIG. 2A, with the sidewall omitted.

In reference to FIGS. 2A–2C, front ridge flaps 34 are located in bottom dispensing flap 26. Front ridge flaps 34 are folded inwardly in a manner, such as described above, to form front ridges 35. Rear ridge flaps 32 are located in end extension 42. Rear ridge flaps 32 are likewise folded inwardly, such as described above, to form rear ridges 33. Bottom flap 26, side extensions 30 and end extension 42 are folded upwardly wherein side extensions 30 and end extension 42 overlap and lie flush with sidewalls 14 and back wall 17 respectively. Thus, side extension can be attached to sidewalls 14 and end extension 42 attached to back wall 17. Rear ridges 33 thereby extend into the interior area of dispensing carton 11 proximate dispensing aperture 29.

Figure 6A:
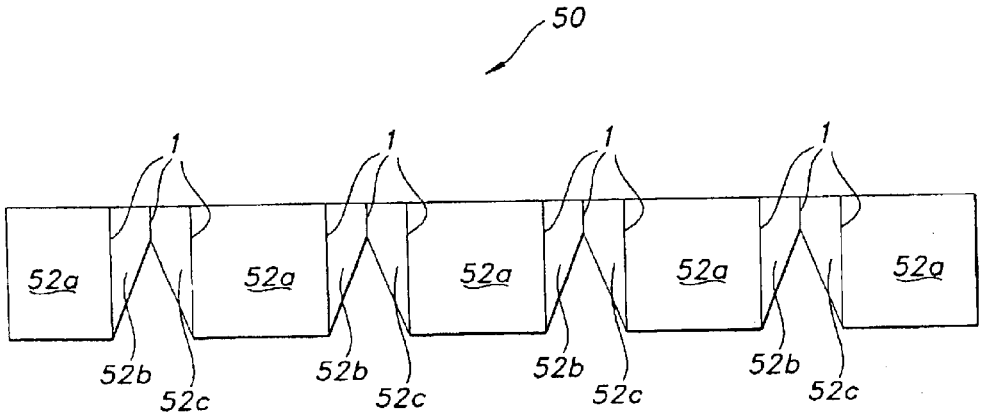
FIG. 6A is a flat-wise view of a blank for making a portion of a dispensing carton.
Figure 6B:
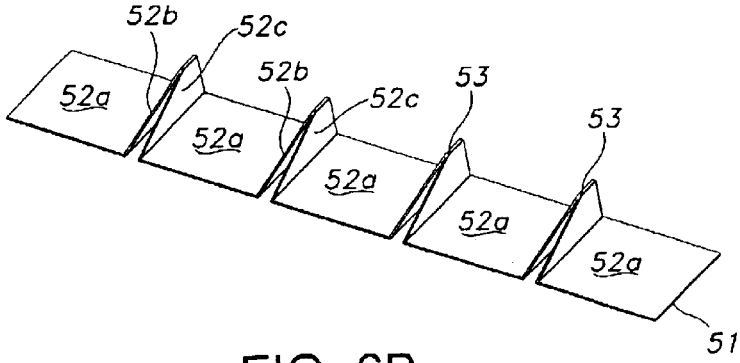
FIG. 6B is a view ridges formed by the blank of FIG. 6A.
Figure 6C:
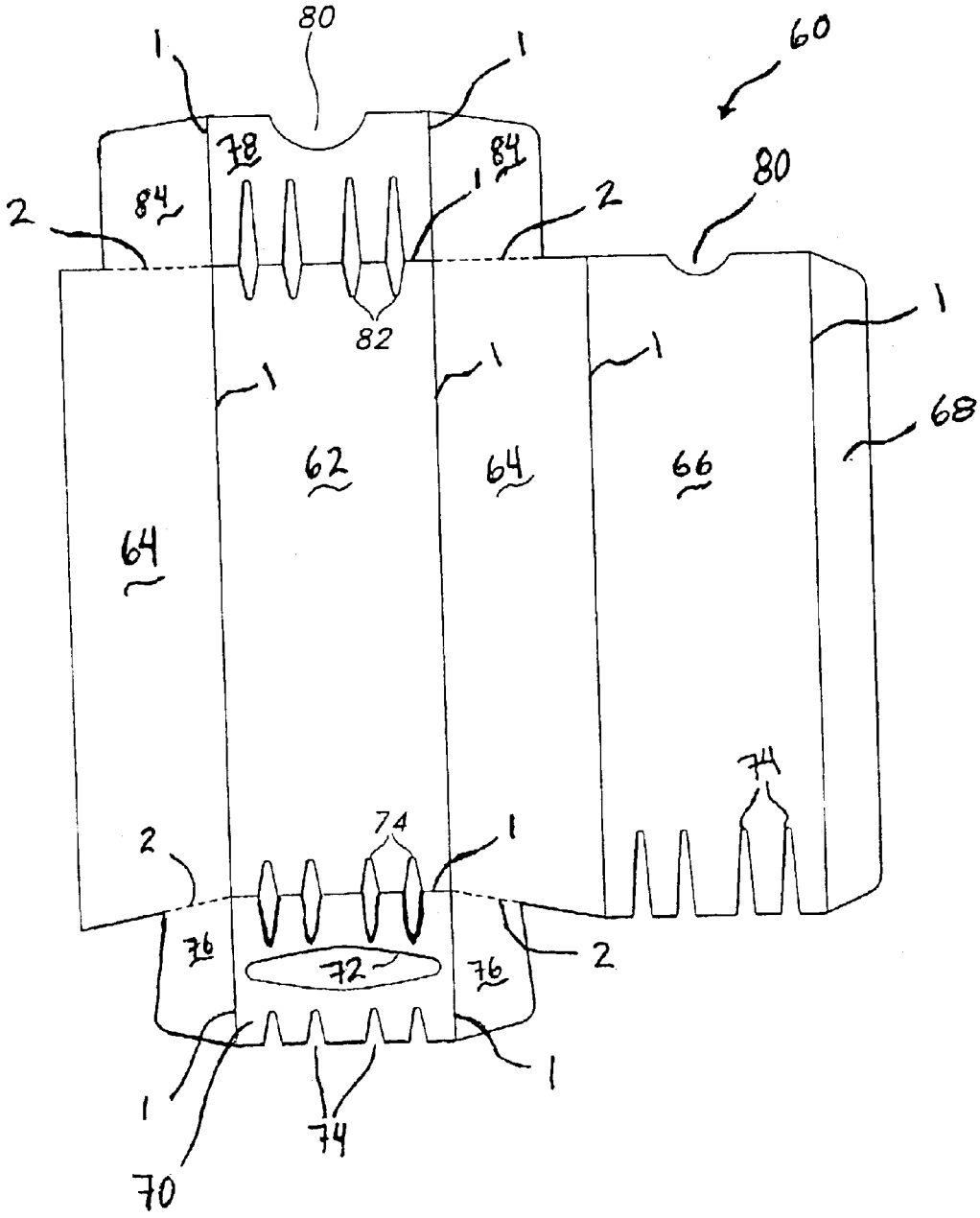
FIG. 6C is a flat-wise view of a blank for forming a portion of a dispensing carton.

In a further embodiment, the dispensing carton can be made from two or more blanks. In reference to FIGS. 6A and 6B, first blank 50 is provided having a plurality of fold lines 1 separating sections 52*a*, 52*b* and 52*c*. Blank 50 is folded such that sections 52*b* and 52*c* are brought into facing relationship with one another. Sections 52*b* and 52*c* can then be attached to one another as desired. In one embodiment, sections 52*b* and 52*c* are attached to one another using a hot melt adhesive. Folding blank 50 and attaching surfaces 52*b*, 52*c* thereby forms ridge member 51 having a plurality of ridges 53 thereon. In reference to FIG. 6C, second blank 60 is provided having front wall section 62, sidewall sections 64, back wall section 66 and edge member 68. Second blank 60 further includes bottom flap 70 having bottom dispensing opening 72 and bottom slit openings 74. Bottom slit openings 74 are positioned proximate the bottom dispensing opening 72 such as, for example, adjacent an outer edge of bottom flap 70. Bottom flap 70 can further include one or more side extensions 76 for attaching to sidewall sections as discussed above. Top flap 78 includes top dispensing opening 80, top slit openings 82 and one or more top side extensions 84.

Carton body 61 is formed by folding wall sections 62, 64, 66 to generally ninety-degree angles. Edge member 68 extending from back wall section 66 is likewise folded approximately ninety degrees and is placed in overlapping or facing relation with sidewall section 64 and attached thereto. Top and bottom flaps 70, 78 are folded inwardly along fold line 1 and respective side extensions 76, 84 are folded to be placed in facing relation with sidewall sections 64. Side extensions 76, 78 and edge member 68 are attached to the sidewall sections 64 to form carton body 61 which, in reference to FIG. 7A, has front wall 63, sidewalls 65, back wall 67 and top and bottom end walls 71, 79. Carton body further includes bottom-slit openings 74, top slit openings 82, top dispensing opening 80 and bottom dispensing opening (not shown). In addition, while the slit openings are shown spanning an end wall and an adjoining vertical wall, it will be appreciated that the slit openings can be formed entirely within an end wall or one of the vertically extending walls.

Figure 7A:
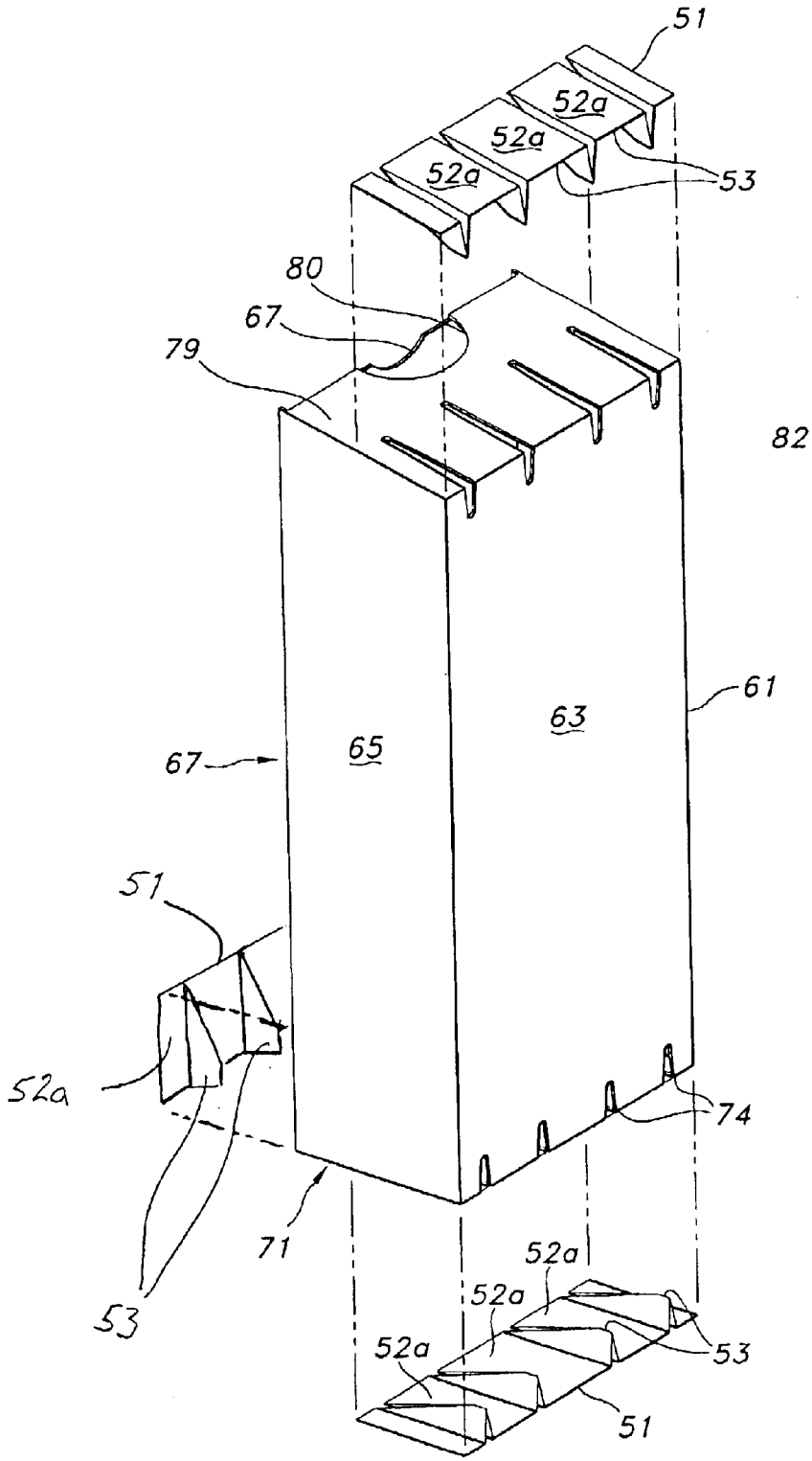
FIG. 7A is an exploded view of carton body formed by the blanks of FIG. 6A and FIG. 6C.
Figure 7B:
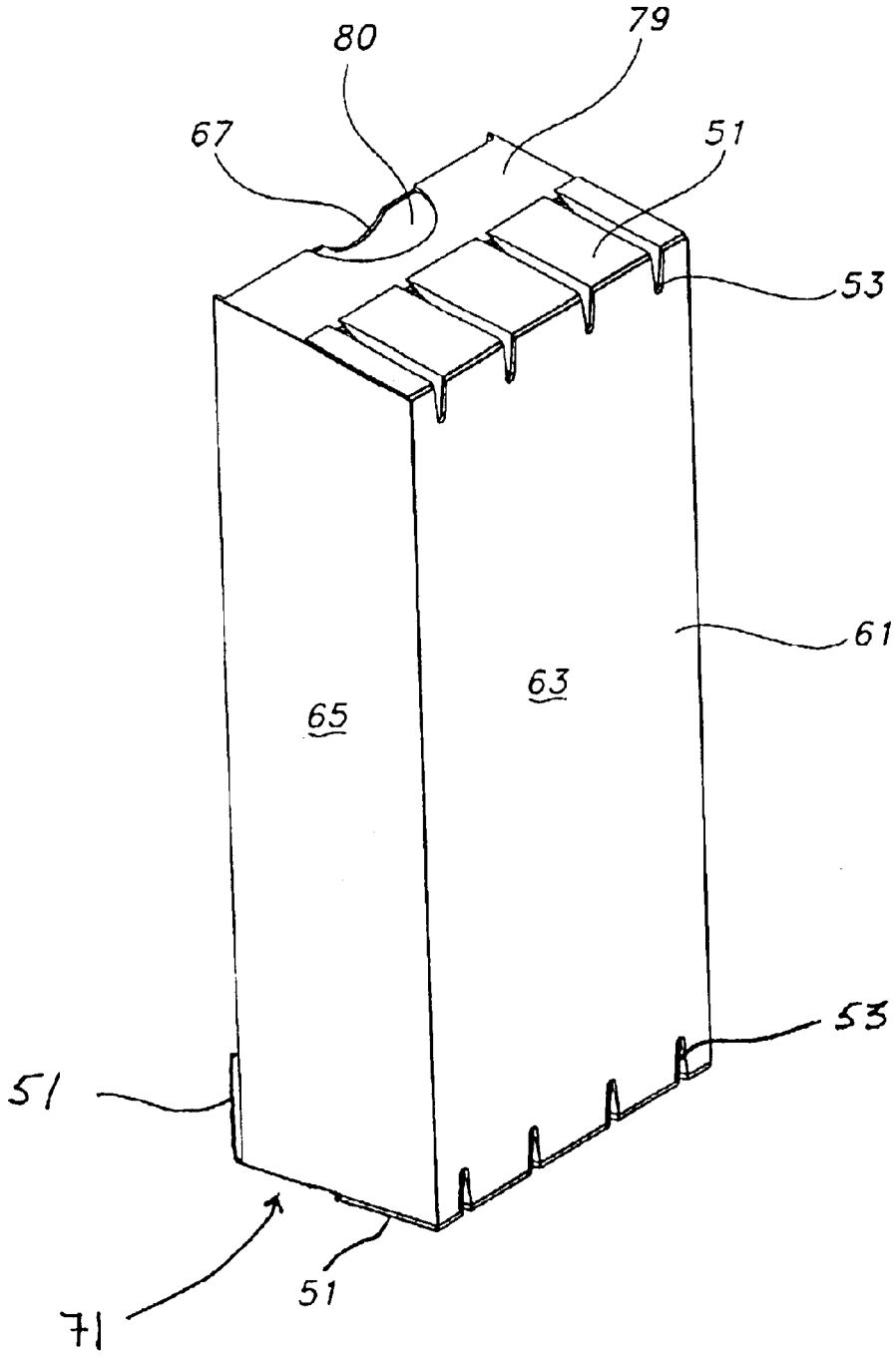
FIG. 7B is a view of a dispensing carton formed from the blanks of FIG. 6A and FIG. 6C.

In reference to FIGS. 7A and 7B, ridges 53 of ridge members 51 are aligned with slit openings 74, 82. Sections 52*a* of ridge members 51 are then brought into contact with walls 67, 71, 79 of carton body 61 such that ridges 53 extend into the interior of carton body 61. Ridge members 51 can then be attached to carton body 61 adhesively and/or by utilizing one or more fasteners. As an example, hot melt adhesive can be applied to sections 52*a* thereby permanently fixing ridge members 51 to walls 67, 71, 79 of carton body 61 and thereby forming dispensing carton 86. The slit openings can be located partly or entirely within one or more of the end, side, front, or back walls proximate the dispensing aperture. In still a further embodiment, the opening within the walls proximate the dispensing opening can be a single or contiguous opening, as opposed to a set of discrete slit openings, wherein the ridge member substantially or completely covers the opening and is bonded to the carton body along the outer two portions of the ridge member.

Figure 8A:
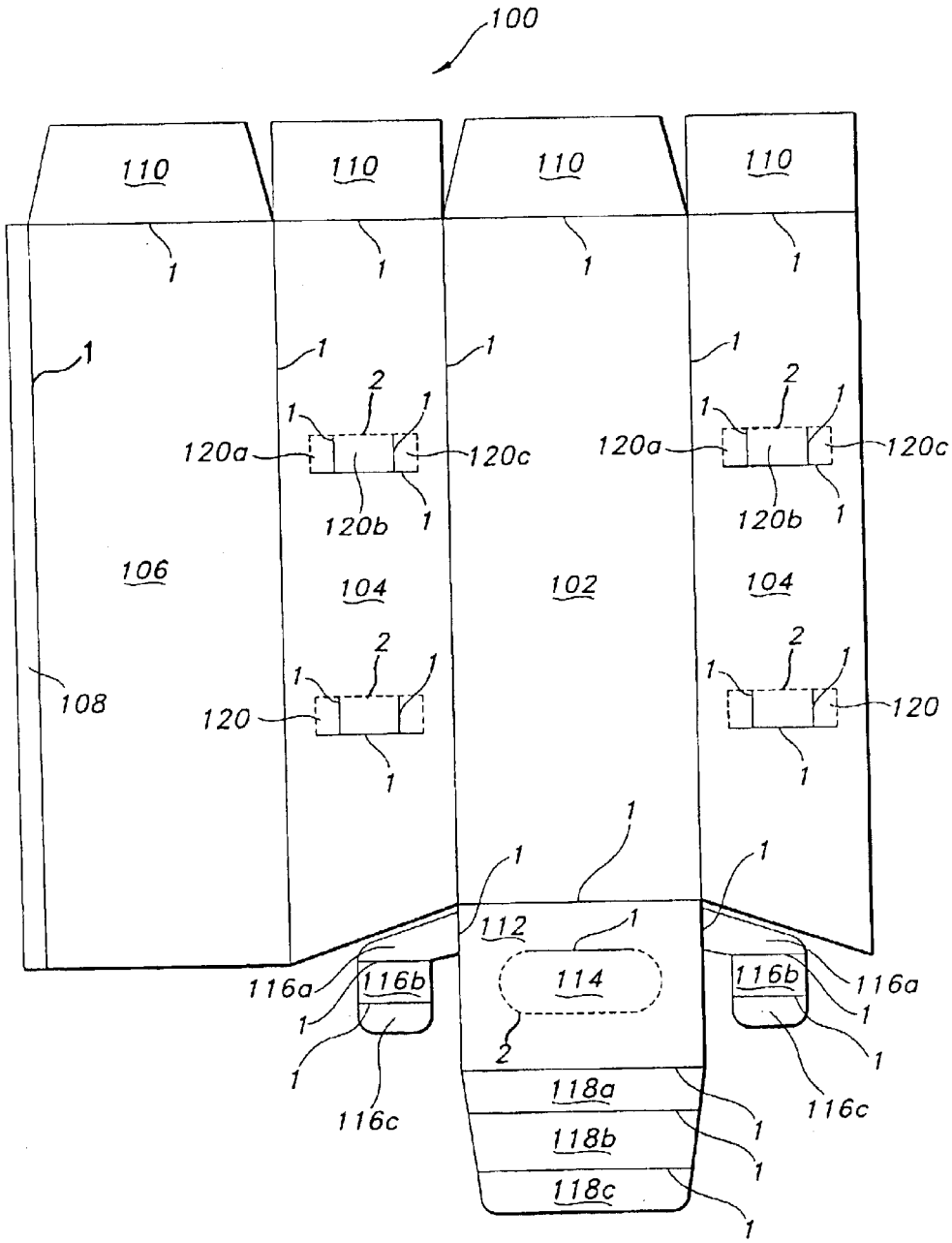
FIG. 8A is a flat-wise view of a blank for making a dispensing carton of the present invention.
Figure 8B:
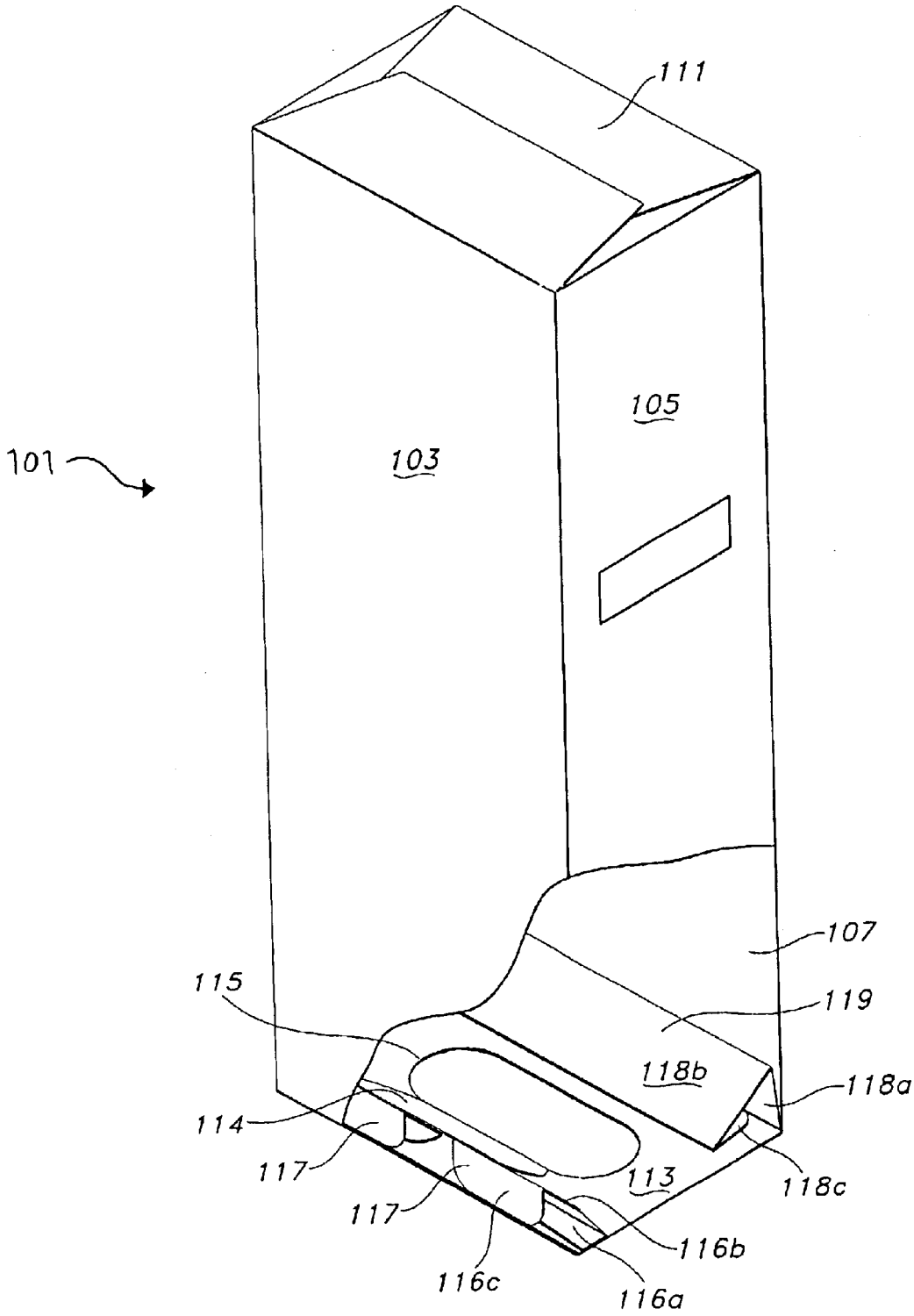
FIG. 8B is a dispensing carton made from the blank of FIG. 8A having a lower portion of the front and sidewall partially broken-away.

In a further embodiment and in reference to FIGS. 8A and 8B, blank 100 includes front wall section 102, sidewall sections 104, back wall section 106 and lip 108. In addition, blank 100 further includes top flaps 110. Dispensing carton 101 is formed by folding wall sections 102, 104, 106 and edge member 108 along fold lines 1 at approximately ninety-degree angles wherein lip 108 is in facing relationship with sidewall section 104. When folded, lip 108 overlaps sidewall section 104 and can be attached thereto by one or means described herein. The corresponding dispensing carton 101 includes front wall 103, sidewalls 105 and back wall 107. Top flaps 110 are folded downwardly along fold lines 1 and inter-leaved to form top end wall 111. The top flaps 110 can, optionally, be secured into position with an adhesive, tape or other fastening mechanism as desired.

Bottom flap 112 includes dispensing aperture flap 114, side extensions 116 and end extension 118. Side extensions 116 are folded, along fold line 1 between bottom flap 112 and side extensions 116, inwardly over bottom flap 112 wherein first section 116*a* is in facing relationship with bottom flap 112. Second section 116*b* is folded, along fold line 1 between first section 116*a* and second section 116*b*, towards front wall section 102 wherein third section 116*c* is placed in facing relation with front wall section 102. Third section 116*c* is folded, along fold line 1 between second section 116*b* and third section 116*c*, such that third section 116*c* extends substantial parallel to and in contact with front wall section 102. Third section 116*c* is attached to first wall section 102 thereby forming front support members 117 in dispensing carton 101. In the embodiment of FIG. 8B, front support members 117 have a generally triangular shape with first section 116*a* extending adjacent bottom end wall 113, third section 116*c* extending parallel to front wall 103 and second section 116*a* spanning bottom end wall 113 and front wall 103. Front support members 117 desirably form a substantially planar surface sloping downwardly from front wall 113 towards dispensing aperture 115. Front support members 117 can extend from adjacent sidewalls 105 to about the midline of the front wall 103 thereby forming a substantially continuous angled plane adjacent dispensing aperture 115. In an alternate embodiment, front support members 117 can extend from proximate sidewalls 105 to slightly past the outer side edge of dispensing aperture 115. Dispensing aperture flap 114 can be folded upwardly, along fold line 1, wherein the dispensing aperture flap 114 rests upon front support members 117. Dispensing aperture flap 114 can be attached to support members 117 or remained unattached. In the latter case, the weight of overlying paper products (not shown) will maintain dispensing aperture flap 114 adjacent front support members 117 and leave dispensing aperture 115 unobstructed.

Bottom flap 112 can further include end extension 118. First, second and third sections 118*a*, 118*b*, 118*c* of end extension 118 are separated by fold lines 1. First section 118*a* is folded upwards, along fold line 1 between bottom flap 112 and end extension 118, wherein first section 118*a* is placed in facing relation to back wall section 106. Second and third sections 118*b*, 118*c* are folded, along fold lines 1, wherein third section 118*c* is placed in facing relationship to bottom end wall section 112 thereby forming back support member 119. In the embodiment of FIG. 8B, back support member 119 has a generally triangular shape with first section 118*a* extending adjacent back wall 107, third section 118*c* extending adjacent and parallel to bottom end wall 113, and second section 118*b* spanning bottom end wall 113 and back wall 107. Back support member 119 forms a substantially planar surface sloped downwardly from adjacent back wall 113 towards dispensing aperture 115. In one embodiment, back support member 119 can extend substantially the entire length of the dispensing aperture 115. In another embodiment, back support member 119 can extend about the same length as dispensing opening 115.

Still in reference to FIGS. 8A and 8B, side protrusions or bumpers (not shown) are formed from bumper flaps 120. Bumper flaps 120 are defined within sidewall sections 104 by fold line 1 and cut lines 2. Bumper flaps 120 are folded inwardly along fold line 1 separating bumper flap 120 and sidewall section 104. First and third sections 120*a*, 120*c* are then folded inwardly toward second section 120*b* wherein first and third sections 120*a*, 120*b* are positioned between second section 120*c* and sidewall section 104/sidewall 105. Second section 120*b* forms a planar surface extending into the interior of dispensing carton 101 sloping downwardly towards dispensing aperture 115. The degree to which bumper 121 extends into the interior of dispensing carton 11, and hence the degree to which bumper 121 extends into the flow path of the paper product (not shown), is directly related to the size of individual sections 120*a*, 120*b*, 120*c*.

Dispensing cartons of the present invention are desirably positioned at a height convenient for pulling paper products from the dispensing aperture. The dispenser can be mounted upon pole, wall or other surface or instrument as desired. In one embodiment, one or more adhesive strips can be located upon a back or side wall of the dispensing carton thereby allowing the carton to be attached to a wall or other surface as desired. As is well known in the art, the adhesive material is desirably covered with a low-adhesion release-strip that can be removed from over the adhesive just prior to use. In a further embodiment, the dispenser can be held in position by the use of hook and loop fasteners. As an example, the back or side panel can contain a hook material and the wall or other surface can contain a corresponding loop material. The dispensing carton and corresponding hook material is placed in engaging relationship with the loop material and thereby held in the desired position. The dispensing carton can thereafter be removed when empty by simply applying sufficient force, e.g. pulling, to disengage the hook and loop materials. By way of example only, conventional hook and loop fastening systems are, for example, distributed under the designation CS200 by the 3M Company of St. Paul, Minn., USA. Another exemplary micro-hook material is distributed under the designation VELCRO CFM-291058, and is available from VELCRO USA, Inc. of Manchester, N.H., USA. In other embodiments, a mounting bracket can be provided for holding the dispensing carton in the desired location. As is known in the art, the bracket can be located on a wall, pole or other location as desired.

Figure 5:
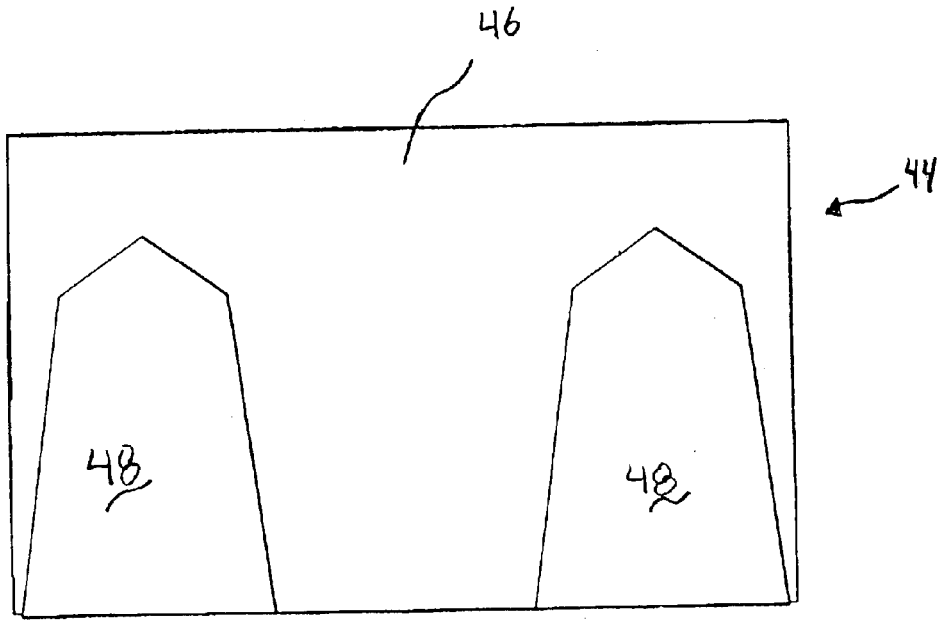
FIG. 5 is a front view of a mounting bracket.

Numerous mounting brackets are known in the art and believed suitable for use with the dispensing carton of the present invention. In one embodiment, the back wall of the dispensing carton can extend above the side and front walls and have therein one or more holes sized to accept a projection, such as a hook or hook-like element, to allow the dispensing carton to be hung in position. In further embodiments, the dispensing carton can contain one or more openings or slits in the walls for accepting a plate upon which the carton is supported. In one embodiment, and in reference to FIG. 2A, one or more slits 4 can be provided in the back wall section 16 of blank 10 to form an access in the corresponding back wall 17 of dispensing carton 11. Mounting bracket 44, such as generally depicted in FIG. 5, has a mounting surface 46 for attaching bracket 44 to a wall or other surface (not shown). When attached to a wall, mounting surface 46 will lie substantially flush against the wall. Mounting bracket 46 further includes a pair of plates that extend vertically and parallel with mounting surface 46. Slit openings 4 can be sized and spaced to accept plates 48. Dispensing carton 11 can then be placed upon plates 48 of mounting bracket 44 wherein plates 48 extend upwardly into the interior area of the dispensing carton, substantially flush with the inside of back wall 17, via slits 4.

Various sheet-like materials can be dispensed from the dispensing cartons of the present invention such as, for example, paper and nonwoven products. Exemplary sheet-like products include, but are not limited to, facial tissue, towels, bathroom tissue, wipers, napkins, seat covers and so forth. The specific composition of the sheet materials dispensed can vary as desired. Exemplary sheet-like materials Include, but are not limited to, those described in U.S. Pat. Nos. 3,301,746; 3,322,617; 3,650,882; 4,100,324; 4,436,780; 4,659,609; 4,737,393; 5,048,589; 5.284,703; 5,399,412; 5,494,554; 5,607,551; 5.672,248; 5,716,691; 5,772,845; 5,776,306; 6,077,590; 6,273,996; 6,096,152 and so forth. The dispensing cartons of the present invention can hold and dispense significant numbers of individual sheets. Desirably, the dispensing carton is sized to hold and dispense at least about 250 sheets. By way of example, the dispensing cartons can contain between about 400 and about 1000 sheets. In certain embodiment, the dispensing carton can contain and dispense between about 700 and about 900 napkins.

While various patents and other reference materials have been incorporated herein by reference, to the extent there is any inconsistency between incorporated material and that of the written specification, the written specification shall control. In addition, while the invention has been described in detail with respect to specific embodiments and/or examples thereof, it will be apparent to those skilled in the art that various alterations, modifications and other changes may be made to the invention without departing from the spirit and scope of the present invention. It is therefore intended that the claims cover or encompass all such modifications, alterations and/or changes.

We claim:

1. A disposable dispensing carton comprising: a plurality of sidewall, each sidewall having a height of at least 35 cm, and first and second end walls defining an interior area; a dispensing aperture located entirely within the first end wall; a plurality of ridges proximate the dispensing opening, said ridges extending substantially perpendicular to the dispensing opening and sloping downwardly toward said dispensing opening, wherein said plurality of ridges include a first set of ridges adjacent a first side of the dispensing aperture and a second set of ridges adjacent a second, opposing side of the dispensing aperture, and wherein said ridges are integral with at least one of said walls.

2. The disposable dispensing carton of claim 1, wherein said first set of ridges and second set of ridges are diametrically opposed to one another.

3. The disposable dispensing carton of claim 1 wherein said ridges are formed from and extend from said first end wall.

4. The disposable dispensing carton of claim 1 wherein said ridges have a width, at their apex, less than about 0.5 cm.

5. The disposable dispensing carton of claim 3 wherein said ridges have a height of between about 2.5 cm and about 6 cm.

6. The disposable dispensing carton of claim 5 including a protruding member extending into the interior area, wherein said protruding member is integral with at least one of said sidewalls.

7. The disposable dispensing carton of claim 6 wherein said protruding member slopes downwardly towards the dispensing aperture and extending into said interior area between about 0.5 and about 3 cm.

8. The disposable dispensing carton of claim 1 wherein said walls comprise paperboard.

9. The disposable dispensing carton of claim 8 wherein said dispensing carton is formed from at least first and second blanks and wherein the first blank forms the dispensing aperture and at least one opening proximate the dispensing aperture and further wherein said second blank forms a member having a plurality of ridges sized and spaced for insertion into said at least one opening.

10. The disposable dispensing carton of claim 1 including at least one opening proximate the dispensing aperture and wherein said ridges extend into the interior area through said at least one opening.

11. The disposable dispensing carton of claim 10 wherein said at least one opening proximate the dispensing aperture comprise a plurality of slit openings and wherein said ridges extend into the interior area through said slit openings.

12. The disposable dispensing carton of claim 11 wherein said slit openings are at least partially located in the first end wall and wherein the ridges extend from a ridge member attached to the first end wall.

13. The disposable dispensing carton of claim 8 wherein said ridges are formed from and extend from said first end wall and further wherein the first end wall includes an opening adjacent said ridges.

14. The disposable dispensing carton of claim 8 wherein said ridges are formed from and extend from at least one of said sidewalls and further wherein the disposable dispensing carton includes and opening adjacent said ridges.

15. The disposable dispensing carton of claim 1 including a second dispensing opening at least partially located in the second end wall; and a plurality of ridges proximate the second dispensing opening, said ridges extending substantially perpendicular to the second dispensing opening and sloping downwardly toward said second dispensing opening and wherein said ridges are integral with at least one of said walls.

16. A disposable dispensing carton comprising: a plurality of sidewalls and first and second end walls defining an interior area, said sidewalls having a height greater than about 35 cm; a dispensing aperture located in the first end wall, said dispensing aperture having first and second opposed sides; a first support member forming a downwardly sloping plane adjacent the first side of the dispensing aperture, said first support member being integral with at least one of said walls; a plurality of protruding members extending into the interior area, wherein said protruding member is integral with at least one of said sidewalls; and a stack of greater than 250 superposed sheets selected from the group consisting of nonwoven and paper products, said stack being positioned at least partially over said dispensing aperture.

17. The disposable dispensing carton of claim 16 wherein said protruding members are formed from and extends from said sidewalls and further wherein said protruding members slope downwardly towards the dispensing aperture and extend into said interior area between about 0.5 and about 3 cm.

18. The disposable dispensing carton of claim 16 including a second support member forming a downwardly sloping plane adjacent the second side of the dispensing aperture and further wherein said dispensing aperture is located entirety within said first end wall.

19. The disposable dispensing carton of claim 18 wherein said first and second support members have a substantially triangular shape.

20. The disposable dispensing carton of claim 18 including a dispensing aperture flap attached to the first side of the dispensing aperture and wherein said dispensing aperture flap is in facing relationship with the sloping surface of the first support member.

21. The disposable dispensing carton of claim 18 including a third support member forming a downwardly sloping plane adjacent the first side of the dispensing aperture and wherein the first and third support members extend inwardly from adjacent one of said sidewalls to at least adjacent the edge of the dispensing aperture.

22. The disposable dispensing carton of claim 17 wherein said first and second support members have a height, adjacent the sidewall, between about 2 cm and about 8 cm.

23. The disposable dispensing carton of claim 22 wherein said first and second support members extend into the interior area between about 2 cm and about 5 cm.

24. The disposable dispensing carton of claim 19 wherein said walls comprise paperboard.

* * * * *